US005492270A

United States Patent [19]

Avery et al.

[11] Patent Number: 5,492,270

[45] Date of Patent: Feb. 20, 1996

[54] SHIPPING CONTAINER

[75] Inventors: James J. Avery, Monroe; Farris N. Duncan, West Monroe, both of La.; Larry D. June, Memphis, Tenn.; Thomas M. West, Greenfield Center, N.Y.; Jack L. Lane, Stow, Ohio; Harold W. Garton, Lawrenceville, Ga.

[73] Assignee: Georgia-Pacific Corporation, Atlanta, Ga.

[21] Appl. No.: 276,902

[22] Filed: Jul. 19, 1994

[51] Int. Cl.[6] ..... B65D 5/46

[52] U.S. Cl. ..... 229/117.24; 229/184; 220/403; 220/409

[58] Field of Search ..... 220/403, 408, 220/409, 410; 229/117.19, 117.23, 117.24, 183, 185, 162

[56] References Cited

U.S. PATENT DOCUMENTS

| | | | |
|---|---|---|---|
| 2,040,209 | 5/1936 | Levyne . | |
| 2,151,733 | 3/1939 | Bonfield . | |
| 2,553,803 | 5/1951 | Zinn, Jr. | 229/184 X |
| 2,797,041 | 6/1957 | Rondone . | |
| 2,942,771 | 6/1960 | Spigelman | 229/117.24 |
| 2,981,455 | 4/1961 | Cope | 229/117.23 X |
| 2,991,906 | 7/1961 | Eligoulachvili . | |
| 3,092,298 | 6/1963 | Scholle . | |
| 3,108,732 | 10/1963 | Curie et al. . | |
| 3,387,764 | 6/1968 | Forrest . | |
| 3,531,043 | 9/1970 | Carlsson et al. | 229/184 X |
| 3,539,090 | 11/1970 | Blasdeu . | |
| 3,667,666 | 6/1972 | Pryor | 229/125.19 X |
| 3,677,459 | 7/1972 | Susuki et al. | 229/117.24 |
| 3,730,416 | 5/1973 | Pilz, III | 229/185 X |
| 3,933,300 | 1/1976 | Dempster | 229/194 X |
| 4,083,447 | 4/1978 | Walters et al. . | |
| 4,140,257 | 2/1979 | Peterson . | |
| 4,279,377 | 7/1981 | Peeples et al. . | |
| 4,535,929 | 8/1985 | Sherman, II et al. . | |
| 4,650,112 | 3/1987 | Booth . | |
| 4,688,979 | 8/1987 | Kupersmit . | |
| 4,715,493 | 12/1987 | Dreyfus | 229/117.24 |
| 4,905,864 | 3/1990 | Balin | 229/939 X |
| 5,209,364 | 5/1993 | LaPoint, Jr. . | |
| 5,390,814 | 2/1995 | Christine et al. | 220/465 |

FOREIGN PATENT DOCUMENTS

| | | | |
|---|---|---|---|
| 3140391 | 4/1983 | Germany | 229/117.24 |

*Primary Examiner*—Allan N. Shoap
*Assistant Examiner*—Christopher J. McDonald
*Attorney, Agent, or Firm*—Banner & Allegretti, Ltd.

[57] ABSTRACT

A container mainly intended for the containment and transport of liquids, free flowing materials, and the like. The container includes a fiberboard container body, a top fiberboard pad, a lifting sling, and a liner bag. The container body includes top and bottom closures and side walls. The lifting sling includes a sling body and a plurality of lifting straps. The sling body is located inside the container body and the lifting straps extend through gabled corner apertures in the top closure. The liner bag fits inside the sling body, contains the flowable materials, and is removably attachable to a top pad of the top closure. The lifting sling arrangement permits the containers to be individually lifted by fork lift trucks and other standard material handling equipment. The bottom closure includes is self-locking and includes four panels. At least two of the panels of the bottom closure include overlapping apertures which permit a user to reach his forearm inside the container and manipulate the panels for assembly.

29 Claims, 6 Drawing Sheets

SHIPPING CONTAINER

FIELD OF THE INVENTION

The present invention relates to a shipping container mainly intended for the containment and transport of liquids, free flowing materials, and the like. More specifically, the present invention relates to a corrugated fiberboard shipping container having a sling arrangement which permits the container to be lifted by fork lift trucks and other standard material handling equipment.

BACKGROUND OF THE INVENTION

The shipping and handling of liquids and other free flowing materials, e.g., powders, pellets, etc., is frequently accomplished by the use of 55 gallon steel drums. However, there are many problems associated with steel drums. Steel drums are difficult to handle when filled and require the use of unique material handling equipment having special lifting attachments. Additionally, steel drums are susceptible to rust and are costly to recycle. Steel drums are also difficult to manually maneuver in an untilled state and are also relatively difficult to open and close. Further, the cylindrical shape of the drums makes them inherently inefficient to store and to ship in cubic freight containers. In addition, steel drums can be comparatively expensive with respect to other types of fluid transport containers.

Corrugated liquid Intermediate Bulk Containers (IBCs) have been designed in an attempt to eliminate many of these problems. However, existing corrugated IBCs have had their share of disadvantages. One such existing IBC is manufactured by Willamette Industries. However, containers of this type require the use of special dollies and/or carts for the individual lifting thereof and cannot be lifted solely by existing standard equipment such as fork lift trucks. Further, while stacking of these containers is possible, they have been known to collapse due to their poor performance to withstand stacking of more than two containers high.

A collapsible lined fiberboard container having a plurality of lifting loops permitting the container to be lifted by a fork lift truck is disclosed in U.S. Pat. No. 5,209,364 to LaPoint, Jr. However, these lifting loops are attached to the outside of the upper corners of the container and they do not help support the contents of the container with respect to the container. Such an arrangement creates an apparent increased susceptibility for the failure of the lifting loops and/or their attachment points during lifting. Further, the container top must be removed for the filling and discharging of the container which can be bothersome and time consuming.

A sling for use with collapsible shipping containers for the transport of sacks containing particulate material for top-filling and bottom-emptying is disclosed in U.S. Pat. No. 4,688,979 to Kupersmit. The collapsible shipping container includes first and second side walls, first and second end walls, a lower wall foldably connected to side wall, and a separable lid member. A plurality of first strap members keep the container in a closed position when fastened. A plurality of second strap members, having D-rings at their ends, extend between the bottom wall and the bottom edges of the end walls. To transport the container, a pair of straps are attached to the D-rings and the container can be hoisted by an overhead transport mechanism having an H-frame lifting element. To unload the sack, the first strap members are released, permitting the bottom wall to drop and exposing the bottom of the sack. The sack is then positioned over a hopper and the bottom of the sack is cut causing the contents of the sack to fall by gravity into the hopper. In a second embodiment, the sack is lifted from container by a unitary harness element. However, neither container embodiment allows for a simplified discharging and filling process and both embodiments require the sack be pierced by a cutting tool for discharging.

A trash bag sling for removing a filled trash bag from an ordinary trash container is disclosed in U.S. Pat. No. 4,140,257 to Peterson. The sling consists of a heavy bottom plate with a pair of straps positioned across each other at their mid-lengths and securely fastened to the bottom plate. However, the sling is only useful for lifting the trash bag from the container and does not facilitate in the lifting or handling of the trash container.

Therefore, a container for transporting free flowing materials is needed which can be handled by fork lift trucks and other standard material handling equipment, can be easily filled and discharged, and has the strength to withstand stacking.

Corrugated fiberboard containers having a wide variety of constructions are well known in the art. Many of these container designs employ closure flaps which may overlap and/or interlock in various fashions to securely close the bottom or top of the container. However, in many applications, the height of the container is too great and access to the closure flaps from the interior of the container is restricted or otherwise hindered.

A container locking bottom comprised of four overlapping flaps, each hinged to a side wall panel is disclosed in U.S. Pat. No. 3,092,298 to Scholle. The first flap is folded inwardly against the container wall interior. A second flap, opposite the first flap, includes a tab portion which locks the side flaps, i.e., the third and fourth flaps. The final step in forming the bottom comprises bending the remaining first flap away from the container wall interior, presumably by reaching inside the top of the container. The second and third flaps include finger holes which overlap to facilitate the disassembling of the bottom closure. However, as the assembly of the closure requires reaching inside the container from the top, it is inadequate for taller containers where access to the first flap from the container interior is impeded due to container height. Further, the finger holes are used exclusively for disassembling the bottom closure and does not facilitate in the assembly of the bottom closure.

Therefore, a corrugated fiberboard container with a strong and reliable bottom closure arrangement which can be quickly and manually assembled without the need to utilize glue or staples to secure the closure assembly is needed where the access to the bottom closure from the container interior is impeded.

SUMMARY OF THE PRESENT INVENTION

In view of the foregoing, it is a principal object of the present invention to provide a shipping container for liquids and other free-flowing material which can be quickly and easily assembled, fits standard pallets, trucks and sea-land containers efficiently, is cost competitive, and is recyclable.

More specifically, it is an object of the invention to provide a corrugated liquid intermediate bulk container having a sling arrangement which permits the container to be lifted and handled by fork lift trucks and other standard material handling equipment.

Additionally, it is an object of the invention to provide a corrugated liquid intermediate bulk container which is puncture resistant and has adequate stacking strength.

A still further object of the invention is to provide a top closure for a container which includes gabled openings for facilitating in the transport and handling of the container by providing load bearing surfaces which oppose the pulling forces of lifting straps.

It is yet another object of the invention to provide a container having a self-locking bottom closure which can be easily assembled without the need to access the closure panels from the top of the container.

Another object of the invention is to provide a container having a self-locking bottom closure with a plurality of closure flaps which include offset apertures to provide gripping areas for the manipulation of the closure flaps.

These and other objects are achieved by the present invention which, according to one aspect, provides a corrugated fiberboard shipping container including a container bottom, a container top having a plurality of apertures therein, container side walls bounding the sides of the container, and a lifting sling. The lifting including a sling body and a plurality of strap sections structurally coupled to the sling body. The strap sections extend from container interior through the apertures in the container top to the exterior of the container. This permits the shipping container to be lifted and transported by lifting the strap sections from the exterior of the shipping container.

In a second aspect, the invention provides for a rectangular corrugated fiberboard shipping container including a plurality of side walls, a bottom wall, a lifting sling having a plurality of strap segments, and a rectangular shaped top closure. The top closure includes gabled openings located at the corners of the top closure permitting the strap segments of the lifting sling to pass through for lifting the container.

In another aspect, the invention provides for a corrugated fiberboard shipping container having a plurality of side walls, a top wall and a bottom closure. The bottom closure includes first, second, third, and fourth panels. The first and second panels are each foldably joined to different side walls. The third and fourth panels are each foldably joined to opposing sides of the second panel. The third and fourth panels are foldable into a position superimposed with respect to the second panel. The second panel and either the third or fourth panel includes apertures therein such that the apertures at least partially overlap each other when the third and fourth panels are folded into the superimposed position. The overlapping apertures create a opening extending through their respective flaps to permit access to the container interior through the opening for assembling the bottom closure.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENTS

Figure 1:
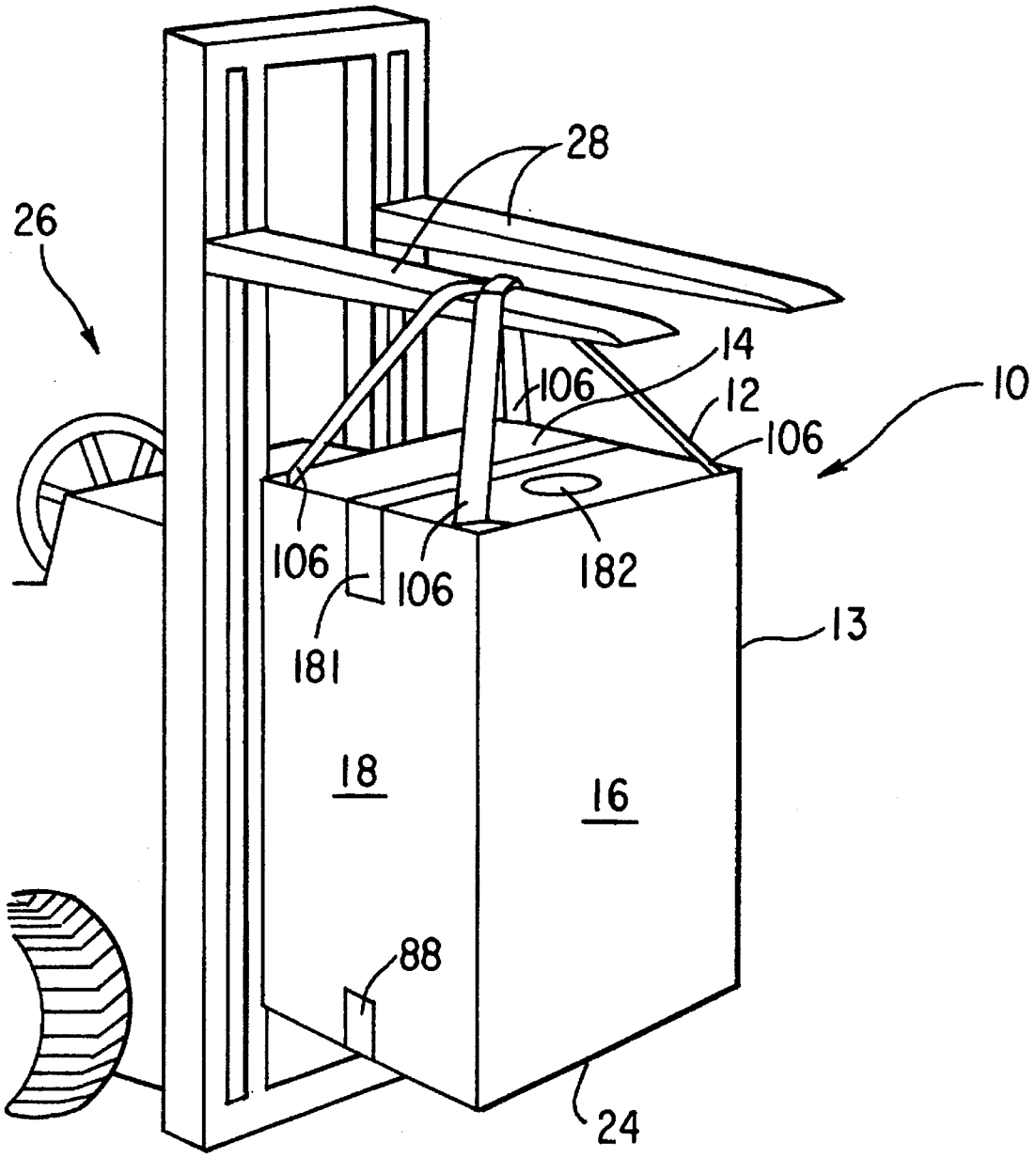
FIG. 1 is a perspective view of the shipping container of the present invention being lifted by a fork lift truck.

Referring to the figures, a corrugated fiberboard shipping container embodying the present invention is generally designated by reference numeral 10. As depicted in FIG. 1, shipping container 10 generally consists of a lifting sling 12 and a container body including a top closure 14, a plurality of side walls 16, 18, 20, and 22 and a bottom closure 24. Standard lifting and transporting equipment with a lifting tool, e.g., fork lift truck 26 with tines 28, is shown lifting and supporting shipping container 10 by sling 12.

Figure 2:
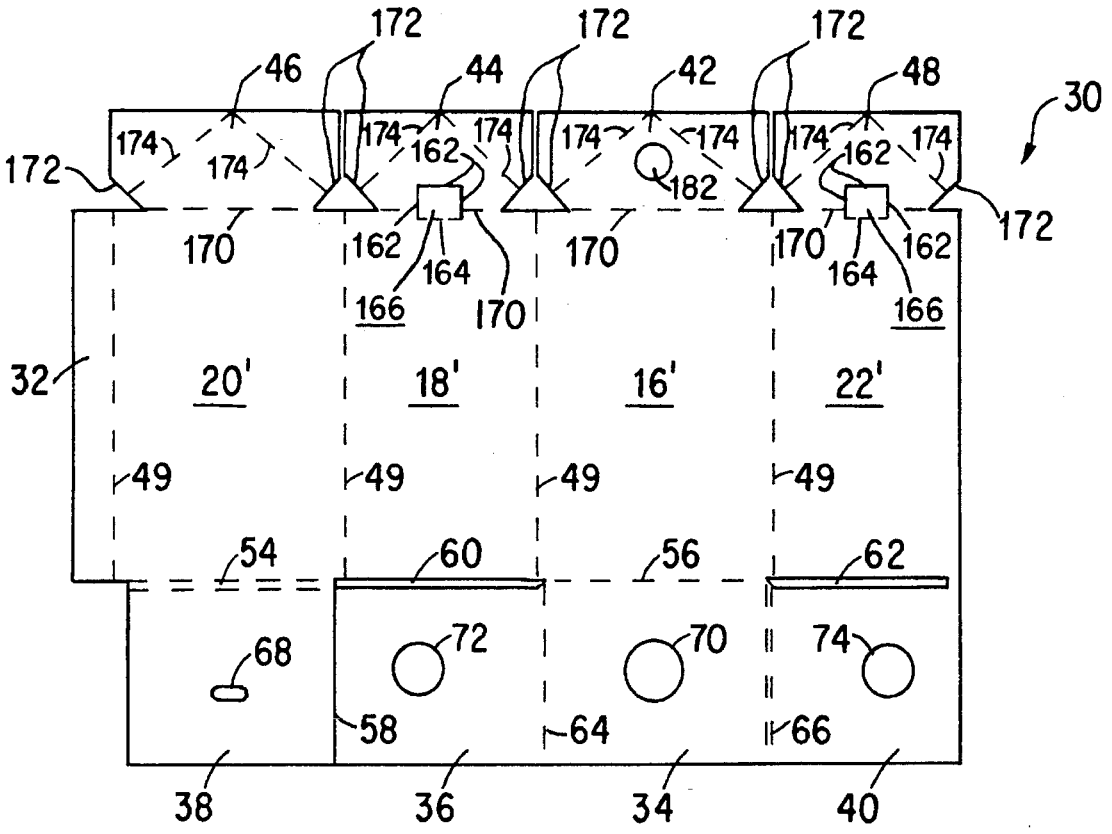
FIG. 2 is a front elevational view of the blank from which the outer side walls, the bottom closure, and the top closure are formed.

FIG. 2 discloses a fiberboard blank 30 used for forming bottom closure 24, at least the outer portion of the side walls 16, 18, 20 and 22, and a portion of the top closure 14. Blank 30 includes side wall panels 16', 18', 20' and 22', a glue joint tab 32, bottom closure flaps or panels 34, 36, 38, and 40 and top closure flaps or panels 42, 44, 46, and 48. Side wall panels 16', 18', 20' and 22' are foldably joined to adjacent side wall panels by fold or score lines 49, while glue joint tab 32 is foldably joined to side wall panel 20' by a similar fold or score line 49.

Figure 3:
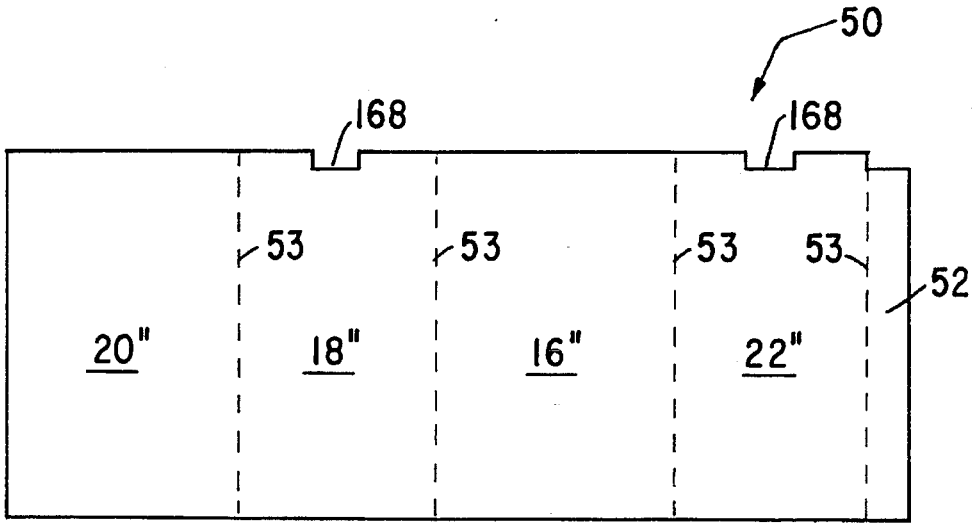
FIG. 3 is a front elevational view of the blank from which the inner side walls are formed.

To provide excellent puncture resistant properties side wall strength for vertical stacking, a second or inner fiberboard blank 50 is laminated to the inside of the first or outer fiberboard blank 30. As illustrated in FIG. 3, inner fiberboard blank 50 includes wall panels 16", 18", 20", and 22" and a glue joint tab 52. In a preferred embodiment, outer fiberboard blank 30 is comprised of a single layer of fiberboard and inner fiberboard blank 50 is comprised of a triple layer fiberboard. Thus, side walls 16, 18, 20 and 22 are respectively comprised of laminated panels 16' and 16", 18' and 18", 20' and 20", and 22' and 22". Similar to the side wall panels in outer blank 30, side wall panels 16", 18", 20" and 22" are foldably joined to adjacent side wall panels by fold or score lines 53, while glue joint tab 52 is foldably joined to side wall panel 22" by a similar fold or score line 53.

A knock-down container body can formed by laminating inner fiberboard blank 50 to the inside of the outer fiberboard blank 30 and by joining glue joint tabs 32 and 52 together to hingeably attach side walls 20 and 22. This creates a container body of rectangular cross-section which can be folded into a flattened state for facilitated storage and transport. While side walls 16, 18, 20 and 22 preferably include a plurality of laminated sections, it is possible to form the knock-down container body solely from the panels in a single blank 30.

To laminate blanks 30 and 50 and to attach glue joint tabs 32 and 52, a cold set adhesive is applied under pressure. However, it is recognized that other adhesives and/or other attachment methods could be used to accomplish these steps.

Bottom panels 34, 36, 38, and 40 are used to form bottom closure 24. First bottom panel 38 and second bottom panel 34 are respectively foldably joined to side walls 20 and 16 by fold or score lines 54 and 56. A cut or slit 58 separates first and third bottom panels 38 and 36 to permit independent movement therebetween. Slots 60 and 62 are respectively cut in blank 30 to separate bottom panels 36 and 40 from their respective adjacent side walls 18 and 22. Slots 60 and 62 are slightly wider than slit 58 to accommodate for the thickness of the inner blank 50, and thus permitting third and fourth bottom panels 36 and 40 to be folded within container body 13. A single fold or score line 64 is provided to foldably join third bottom panel 36 to one side of second bottom panel 34, while a double fold line 66 is provided to foldably join the fourth bottom panel 40 to the opposing side of second bottom panel 34. Double fold or score line 66 accounts for the thickness of third bottom panel 36 and permits fourth bottom panel 40 to be folded onto second and third bottom panels 34 and 36.

For the purpose of assembling and disassembling bottom closure 24, bottom panels 34, 36, 38, and 40 each include an aperture therein. First bottom panel 38 includes a gripping aperture 68 facilitating a user to grab first bottom panel 38 with his fingers for pivoting first bottom panel 38 with respect to side wall 20. Gripping aperture 68 is preferably oval shaped having a width sufficient to accommodate a user's fingers, however, it may take the form of any shaped and sized cutout which facilitates a user to grab first bottom panel 38 with at least one finger.

Figure 7:
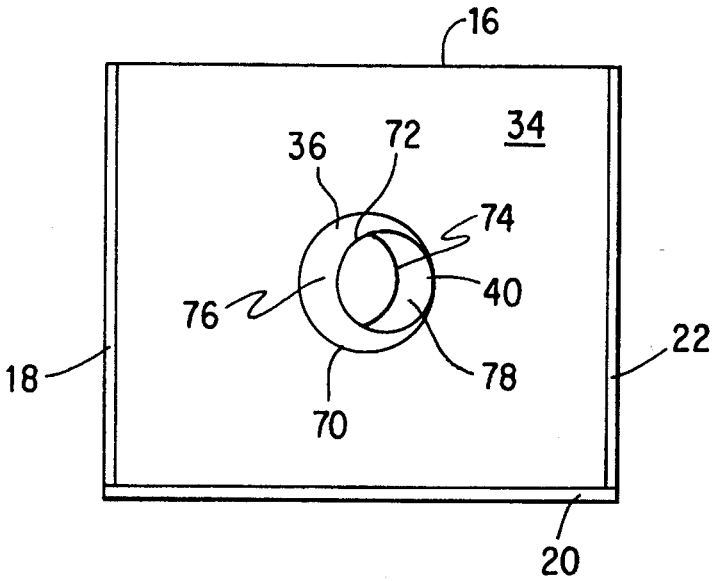
FIG. 7 is a bottom view of the container showing the offset relationship of the circular assembly apertures.

Second, third and fourth bottom panels 34, 36, and 40 include respective circular apertures 70, 72, and 74. Circular apertures 72 and 74 in third and fourth bottom panels 36 and 40 are slightly smaller than, and offset from, aperture 70 in second bottom panel. The origins of circular aperture 72 and 74 are offset in opposite directions in order to create respective moon-shaped gripping areas 76 and 78 as depicted in FIG. 7.

The overlap between circular apertures 70 and 72 must be sufficiently large to permit a human forearm to penetrate and to fold fourth bottom panel 40 to a position against the inside of side wall 22. Circular aperture 70 must be sufficiently large to permit a human arm to penetrate and to fold third bottom panel 36 to a position against the inside of side wall 18. In a preferred embodiment, circular aperture 70 in second bottom panel 34 is preferably six inches in diameter while apertures 72 and 74 are five inches in diameter and when folded upon second bottom panel 34 have origins offset from the origin of aperture 70 by one inch in opposite directions. However, it is recognized that other aperture sizes and placements can be used in order to permit penetration for a user's hand and forearm and to provide gripping areas 76 and 78.

Figure 6:
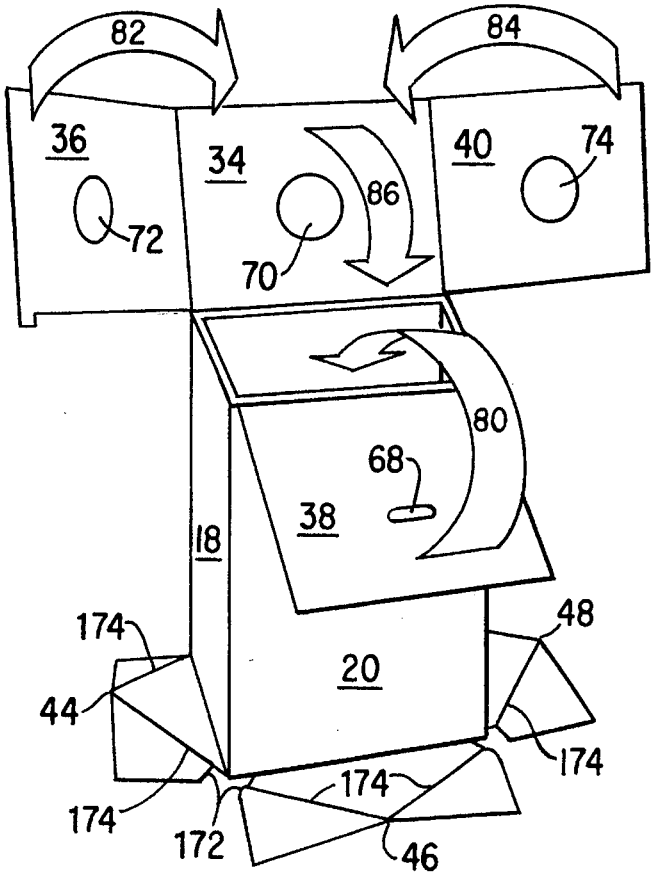
FIG. 6 is a perspective view of the container, positioned upside-down, depicting the steps for assembling the bottom closure.

To assemble bottom closure 24, container body 13 is placed in an upside-down orientation as shown in FIG. 6. First bottom panel 38 is folded in the direction shown by arrow 80 so that first bottom panel 38 is substantially against the interior of side wall 20. Third bottom panel 36 is then folded 180° in the direction shown by arrow 82 so that third bottom panel 36 is substantially superimposed on second bottom panel 34. In this position, circular aperture 72 of third bottom panel 36 should overlap at least part of circular aperture 70 of second bottom panel 34 to provide gripping area 76. Fourth bottom panel 40 is then folded 180° in the direction shown by arrow 84 so that fourth bottom panel 40 is substantially superimposed on second and third bottom panels 34 and 36. In this position, circular aperture 74 of fourth bottom panel 40 should overlap at least part of circular apertures and 72 of the second and third bottom panels 34 and 36 to provide gripping area 78. The second panel 34 with third and fourth bottom panels 36 and 40 superimposed thereon is folded 90° inwardly in the direction shown by arrow 86 to a position perpendicular to the side walls.

Figure 8:
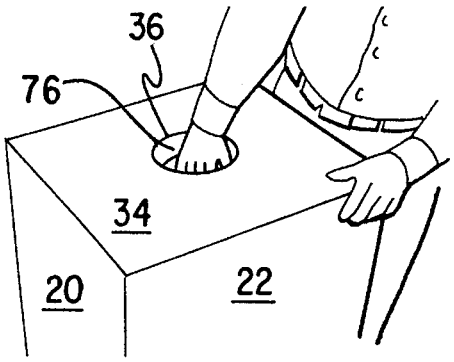
FIG. 8 is a perspective view of the container, positioned upside-down, showing a user performing an assembly step for the bottom closure.

The user then reaches his hand and forearm through circular apertures 70 and 72 in second and third bottom panels 34 and 36 and grabs fourth bottom panel 40 via gripping area 78. Fourth bottom panel 40 is then folded 90° against the interior of side wall 22. As illustrated in FIG. 8, the user then reaches his hand and forearm through circular aperture 70 in second bottom panel 34 and grabs third bottom panel 36 via gripping area 76. Third bottom panel 36 is then folded 90° against the interior of side wall 18, in a manner similar to that of fourth bottom panel 40.

To complete the assembly of bottom closure 24, the user reaches his hand and forearm through circular aperture 70 in second bottom panel 34 and grabs first bottom panel 38 via gripping aperture 68. First bottom panel 38 is folded 90° to a position perpendicular with the side walls and substantially superimposed with second bottom panel 34 to form a self-locking bottom closure. Tape 88 may be used to affix second bottom panel 34 to side walls 18 and 22 and strengthen bottom closure 24. However, the use of tape 88 may not be necessary to provide the necessary bottom closure strength.

Figure 4:
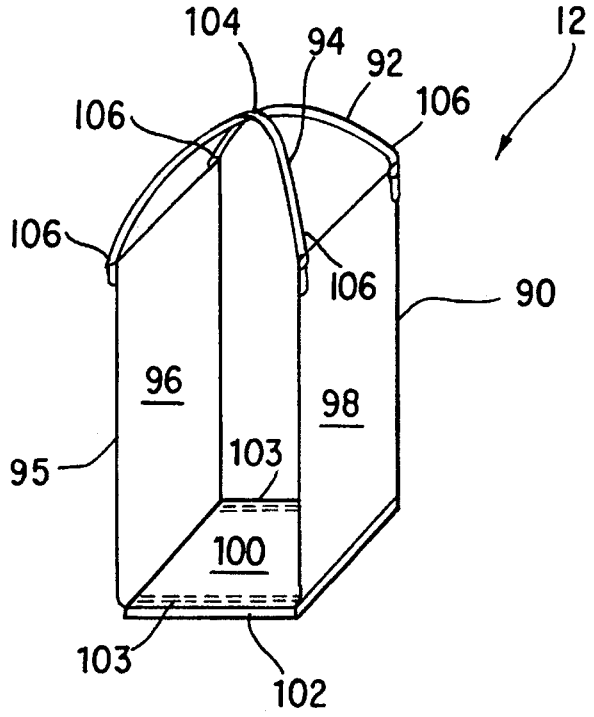
FIG. 4 is an isometric view of a first embodiment of the lifting sling.
Figure 9:
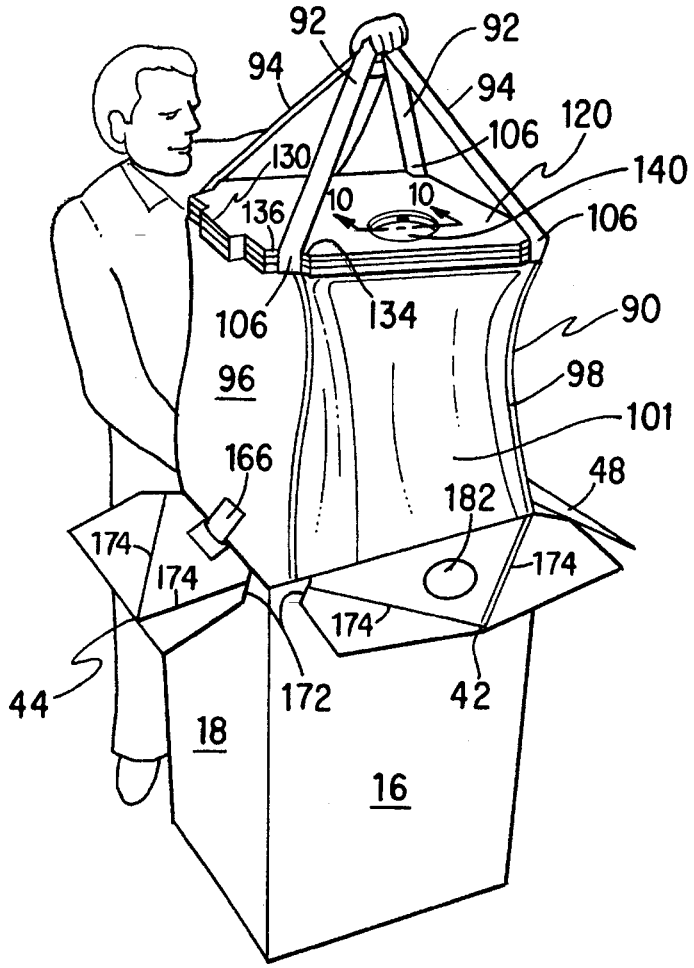
FIG. 9 is a perspective view of the container showing a user positioning the lifting sling and the liner bag inside the container.

Lifting sling 12, as shown in FIG. 4, includes a sling body 90 and two straps 92 and 94, each joined at its ends to the upper portion of sling body 90. Sling body 90 includes an elongated sheet of flaccid material 95 which forms opposing lateral support wall portions 96 and 98 and a floor portion 100. Sling body 90 effectively creates a pouch or compartment for containing and bounding a liner bag 101 from the bottom and from two sides, as best shown in FIGS. 4 and 9. Sling body 90 is preferably a woven polypropylene material and straps 92 and 94 are preferably a woven nylon material. However, it is recognized that other materials could be used in lieu of the woven polypropylene and nylon.

A bottom pad 102 is fixedly attached to floor portion 100 to help define the shape of sling body 90 and facilitate in positioning lifting sling 12 inside container body 13. Bottom pad 102 is shaped and sized to substantially fit the inner dimensions of container body 13 for maximizing the dimensions of sling body 90 within the container body 13. Bottom pad 102 is preferably made of a fiberboard material and is fixedly attached to floor portion 100 by stitching 103. However, attachment techniques, e.g., adhesives, staples, could be used in addition to, or in lieu of, sewing the elements together.

Straps 92 and 94 are also preferably joined to the sling body 90 by sewing the ends of straps 92 and 94 to the upper opposing corners of lateral support wall portions 96 and 98. Straps 92 and 94 are secured to each other at their respective midpoints at 104 to form a unitary cross-shaped strap configuration.

When sling is in its assembled position inside container body 13, the lower four segments 106 of the strap configuration, i.e., the ends of straps 92 and 94, extend through top closure 14 so that container 10 may be lifted by one or more fines 28 of a fork lift truck or other standard material handling equipment in a manner depicted in FIG. 1. This strap configuration is advantageous because it permits fork lift trucks to approach the container and insert a tine or tines into the strap arrangement from any of the container sides.

Figure 5:
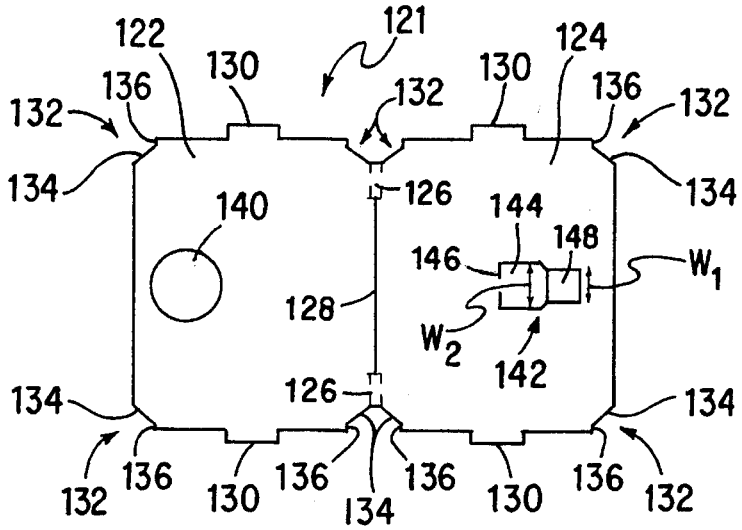
FIG. 5 is a top view of the blank from which the top pad is formed.

Top closure 14 includes a top pad 120, as shown in FIGS. 5 and 9, and top wall panels 42, 44, 46 and 48, as shown in FIGS. 2, 6, 9, and 10. As illustrated in FIG. 5, top pad 120 is made from a fiberboard blank 121 and includes upper and lower halves 122 and 124. Halves 122 and 124 are hingeably connected to each other via double score or fold lines 126. A slit 128 is made between halves 122 and 124 to facilitate the folding therebetween. To form top pad 120 from blank 121, upper half 122 is folded upon lower half 124.

Upper and lower halves 122 and 124 have identically sized peripheries which include a pair of locating and supporting tabs 130 and notched corners 132. Each notched corner 132 is generally triangular shaped, i.e., gabled, which includes a strap load bearing surface 134 and a stepped edge surface 136. Strap load bearing surfaces 134 each extend in a direction perpendicular to a line extending to the center of top pad 120, and oppose the pulling force of the strap sections 106 when container 10 is lifted. The stepped edge surfaces 136 in the notched corners 132 inhibit the strap from sliding off strap load bearing surfaces 134.

Figure 10:
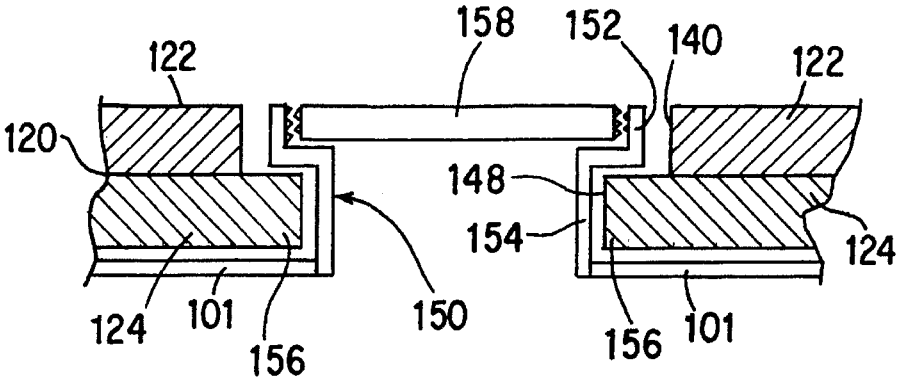
FIG. 10 is a cross-sectional view through Line 10—10 of FIG. 9.

Upper half 122 differs from lower half 124 in that upper half 122 includes a circular fitment clearance aperture 140 and lower half 124 includes a fitment interface 142. Fitment interface 142 includes a keyhole flap 144 hingeably attached at score line 146 and a square aperture 148. The width $w_2$ of keyhole flap 144 is greater than the width $w_1$ of square aperture 148. As shown in FIG. 10, this permits fitment 150, which is attached at or near the top of plastic liner bag 101, to be removably attachable to top pad 120. To accomplish this, fitment 150 includes a spout 152 and a reduced width or diameter collar 154. The width $w_1$ of square aperture 148 is preferably smaller than the width or diameter of spout 152 but larger than the width or diameter of the collar 152.

To attach fitment 150 of liner bag 101 to top pad 120, keyhole flap 144 is pivoted upwardly and spout 152 is inserted therethrough. Fitment 150 is then moved into square aperture 148 so that the retaining ledges 156 of square aperture 148, i.e., the material immediately surrounding aperture 148, supports spout 152 and prevents fitment 150 from falling into container body 13 when installed. A removable cap 158 is removed from spout 152 for filling or discharging liner bag 101, and attached to spout 152 for shipping and handling of container 10. The fitment 150 and top pad 120 arrangement is particularly desirable when liner bag 101 is used for holding liquids or other flowable matter.

Top pad 120 is designed to fit within the top of container body 13. To accomplish this, locating and supporting slots 160 are formed in the upper periphery of opposing side walls 18 and 22 which interface with the supporting and locating tabs 130 of top pad 120. This locates top pad 120 with respect to container body 13 and to supports top pad 120 when a downward force it applied thereto by fitment 150 and the weight of liner bag 101. Each locating and supporting slot 160 is formed by one top and two side slits or cuts 162 and a bottom fold or score line 164. A hinged portion 166 is formed by cuts 162 and score 164 which can be folded inwardly toward the container interior and forming locating and supporting slot 160 in the void created by the folded hinged portion 166. Wall sections 18" and 22" on inner blank 50 include cutouts 168 which are sized to create continuous slots 160 through the laminated side walls 18 and 22. Top pad 120 and container body 13 include two respective tabs 130 and slots 160 located on opposing sides. However, it is recognized that the locating tabs and slots need not be limited to two in number or limited to placement on only two sides of top pad 120 and container body 13. Further, blank 121 is preferably made of triple wall fiberboard to create a six-ply thickness for top pad 120 to support the loads imparted by strap segments 106. However, is it recognized that top pad designs of other thicknesses could be used.

Top wall panels 42, 44, 46 and 48 are foldably joined to side walls 16, 18, 20 and 22 by fold or score lines 170 and are pivoted to a position on top of the installed top pad 120 to complete top closure 14. The comers of top wall panels 42, 44, 46, and 48 adjacent score lines 170 have triangular shaped cutouts 172 therein, i.e., they are gabled. When top wall panels 42, 44, 46, and 48 are pivoted on top of top pad 120, triangular shaped cutouts 172 will generally superimpose the notched corners 132 of top pad 120 to permit strap segments 106 to pass therethrough. If desired, the inner edges of triangular shaped cutouts 172 could be sized so that they also form a strap bearing surface for strap segments 106.

Figure 11:
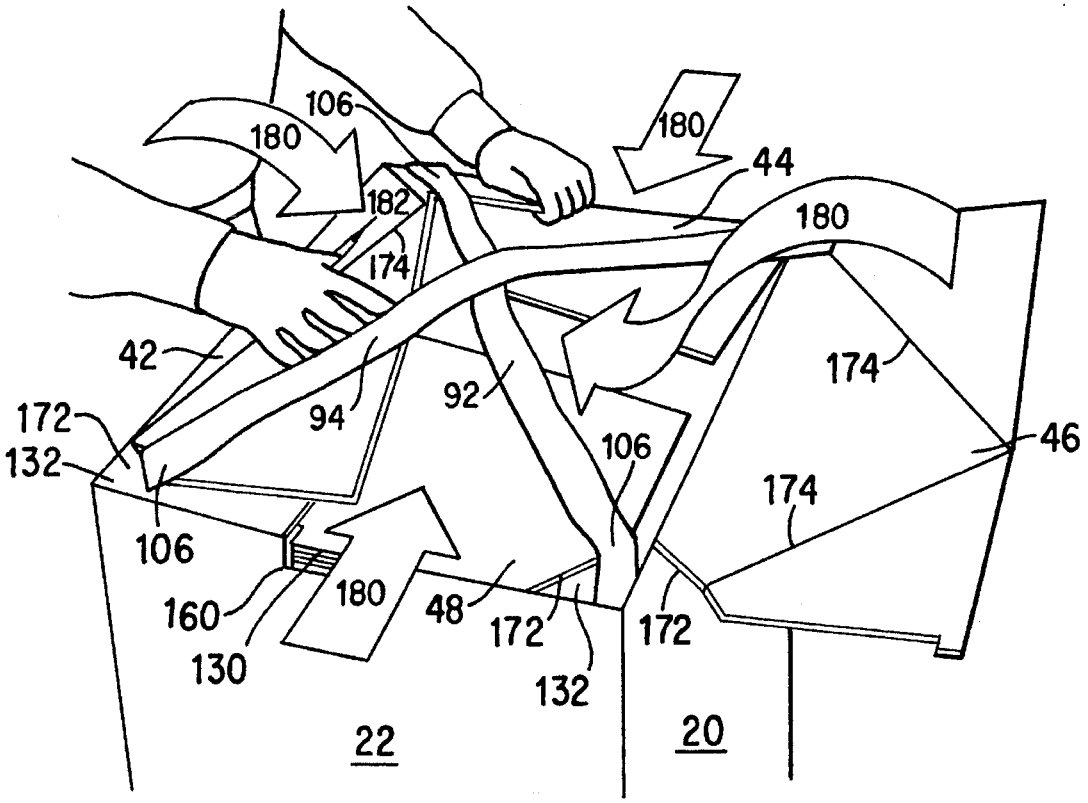
FIG. 11 is a perspective view of the container depicting the steps for assembling the top closure.

To facilitate the folding thereof, each top wall panel 42, 44, 46, and 48 includes a pair of fold or score lines 174. As depicted in FIG. 11, fold lines 174 permit panels 42, 44, 46, and 48 to be folded into position on top of top pad 120 without interference by the straps 92 and 94 of the sling body 12. This is accomplished by slightly folding the triangular ends of top wall panels 42, 44, 46, and 48 along fold lines 174 while top wall panels 42, 44, 46, and 48 are being folded with respect to side walls 16, 18, 20, and 22 in the direction of arrow 180. This permits panels 42, 44, 46, and 48 to pass beneath straps 92 and 94 without interference. As shown in FIG. 1, tape 181 may be used to maintain top wall panels 42, 44, 46, and 48 in the folded position. A circular aperture 182 on top wall panel 42 overlies aperture 140 on top pad 120 to permit access to spout 152 for the filling and discharging of liner bag 101 when top closure 14 is completed.

To assemble container 10, a knock-down container body is formed off-site at a factory. This is achieved by first laminating blanks 30 and 50 and attaching glue joint tabs 32 and 52 as previously described. Container body 13 is then collapsed or "knocked-down" into a flattened state.

Container body 13 in a knock-down form is shipped to the locale where it is to be assembled and filled. At the assembly site, the container is squared and is oriented upsidedown, as shown in FIG. 6. Once upside-down, bottom closure 24 can be assembled in the manner as previously described and returned to its right-side-up orientation.

Top pad 120 is attached to plastic liner bag 101 via fitment interface 142 in top pad 120 and fitment 150 on the plastic liner bag 101. Sling 12 is then placed in the container interior. The plastic liner bag 101 and top pad 120 assembly is placed inside sling 12 making sure that strap segments 106 are positioned on strap load bearing surfaces 134 of to pad 120. Locating and supporting tabs 130 of top pad 120 are placed within locating and supporting slots 160 in container side walls 18 and 22, making sure that the strap sections 106 emerge from all four corners apertures 132.

At this point, the top wall panels 42, 44, 46, and 48 will be closed utilizing the scores 174 on top wall panels 42, 44, 46, and 48. Once closed, top wall panels 42, 44, 46, and 48 may be taped 181 or otherwise temporarily affixed for handling and shipping. The assembly of container 10 is now completed and it is apparent that sling body 90 is located within the container interior area defined between top closure 14, bottom closure 24, and side walls 16, 18, 20, and 22, while strap sections 106 extend from container interior through apertures 132 and 172 in top closure 14 to the exterior of the container.

To fill container 10, cap 158 on the fitment 150 may be detached to expose spout 152. Liner bag 101 may then be filled via spout 152 through any conventional technique. Once filled, container 10 may be picked up by fork lift trucks and other standard material handling equipment by placing a tine 28 or other similar lifting tool through the straps 92 and 94.

When container 10 is filled the fluid or flowable matter in liner bag 101 forces the liner bag 101 and lateral wall support portions 96 and 98 of sling body 90 against the inside of side walls 16, 18, 20, and 22. Thus, when container 10 is lifted, the lifting force applied by strap segments 106 are balanced by: (i) the friction forces between liner bag and lateral wall support portions 96 and 98 and side walls 16, 18, 20, and 22 as liner bag 101 pushes outward, (ii) the taped 181 folded top wall panels 42, 44, 46, and 48 resisting the upward movement of top pad 120, and (iii) the balanced inward forces resisted by load bearing surfaces 134.

In lieu of liner bag 101 with fitment 150, a liner bag could have an open top without a fitment. In such an arrangement, the open top liner bag would be placed inside lifting sling 12 situated inside container body 13. The open top liner bag would then be filled and the top of the bag gathered and tied off with a twist tie or other device. Top pad 120 would then be placed into its position making sure strap segments 106 are properly positioned in the voids or apertures formed by gabled corners 132. Top wall panels 42, 44, 46, and 48 are then closed and the container can be lifted as previously described. The use of an open top liner bag design eliminates the necessity for fitment interface 142 and clearance aperture 140 on top pad 120 and circular aperture 182 on top wall panel 182, as the open top liner bag is not attached to top pad 120.

Figure 12:
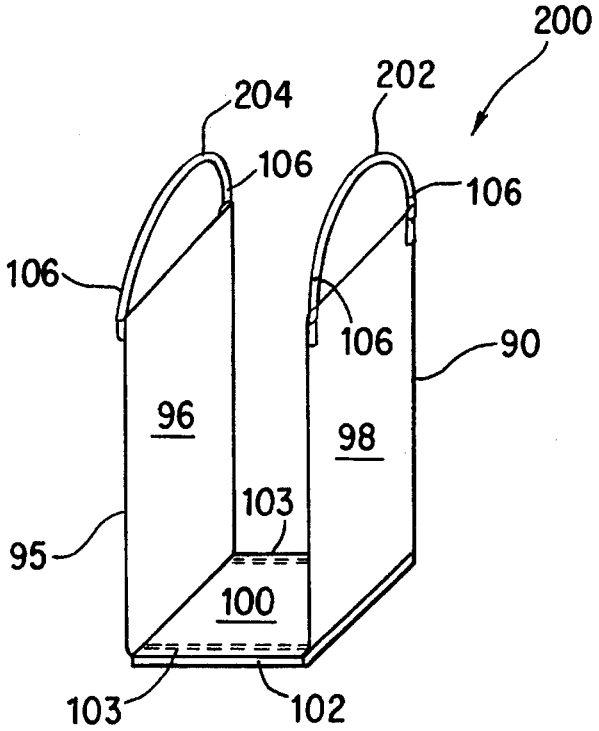
FIG. 12 is an isometric view of a second embodiment of the lifting sling.

An alternate embodiment of a lifting sling is shown in FIG. 12. Lifting sling 200 is similar to lifting sling 12 as shown in FIG. 4 except for the lifting strap arrangement. The lifting strap arrangement of FIG. 12 differs in that the two straps 202 and 204 are parallel to each other instead of diagonally crossing and they are not attached at their respective midpoints. To lift a container having with sling 200 of FIG. 12, at least one tine is inserted into strap arrangement perpendicular to straps 202 and 204 making sure the tine or tines extend through both straps 202 and 204.

The strap configuration of FIG. 12 is advantageous because it permits easy placement and removal of top pad 120 with respect to lifting sling 200 and container body 13 and allows for simplified open top container filling utilizing an open top liner bag design as previously described. This is accomplished by the ability of straps 202 and 204 to be folded downwardly on the outside of opposing sidewalls to provide substantially unencumbered access to the container interior.

There are numerous advantages to using container 10. First, because of its inherent cubic shape, is fits standard pallets, trucks and sea-land containers efficiently for transport. In addition it is environmentally friendly as: (i) it is collapsible and potentially reusable if properly handled and (ii) it is recyclable as other fiberboard material. Further, it is cost competitive and can be used for other products which are not flowable, e.g., articles not needing a liner bag. In addition, the strength of laminated side walls permit the multiple containers to be vertically stacked.

While the container side wall arrangement of the preferred embodiment includes four sides in a rectangular configuration, it would be possible to construct the present invention with more than four sides. However, an even number of sides would be required for collapsing the container. Further, if desired, it would also be possible to construct the present invention in a circular side wall arrangement.

It is to be understood that the disclosed embodiments are merely illustrative of the principles of the present invention which could be implemented by other types of structures which would be readily apparent to those skilled in the art. Accordingly, the scope of the present invention is to be determined in accordance with the appended claims.

We claim:

1. A shipping container comprising:

a container bottom comprised of a corrugated fiberboard material;

a container top comprised of a corrugated fiberboard material, said container top including a plurality of apertures therein;

container side wall means for bounding the sides of the container, said side wall means comprised of a corrugated fiberboard material and being structurally coupled to said container top and to said container bottom, said container top, container bottom, and side wall means defining a container interior therebetween; and a lifting sling, said lifting sling including a sling body having an upper end, a lower end, and a wall portion therebetween, and a plurality of strap sections structurally coupled to said sling body and extending from the upper end of the sling body, said sling body being located in said container interior with the wall portion of the sling body positioned immediately adjacent the container side wall means, said plurality of strap sections extending from the container interior through said plurality of apertures in said container top to the exterior of the container, wherein said shipping container may be lifted and transported by lifting said plurality of strap sections from the shipping container exterior.

2. The shipping container of claim 1, further comprising a liner bag positioned within said container interior for holding free flowing materials.

3. The shipping container of claim 2, wherein said liner bag includes a fitment for the filling and discharging the liner bag, said container top including a fitment aperture including a ledge for retaining the fitment.

4. The shipping container of claim 1, wherein said side wall means is comprised of multiple wrap-around side wall members laminated together.

5. A shipping container comprising:

a container bottom comprised of a corrugated fiberboard material;

a container top comprised of a corrugated fiberboard material, said container top including a plurality of apertures therein;

container side wall means for bounding the sides of the container, said side wall means comprised of a corrugated fiberboard material and being structurally coupled to said container top and to said container bottom, said container top, container bottom, and side wall means defining a container interior therebetween; and a lifting sling, said lifting including a sling body and a plurality of strap sections structurally coupled to said sling body, said sling body being located in said container interior, said plurality of strap sections extending from the container interior through said plurality of apertures in said container top to the exterior of the container, wherein said shipping container may be lifted and transported by lifting said plurality of strap sections from the shipping container exterior;

wherein said sling body of said lifting sling includes a bottom pad and lateral supports, said bottom pad being fixedly attached to said lateral supports.

6. The shipping container of claim 5, wherein said side wall means includes at least first and second pairs of opposing walls, said lateral supports include a woven material which extends upwardly from substantially the container bottom towards the container top and along the interiors of at least one said pair of said opposing walls.

7. A shipping container comprising:

a container bottom comprised of a corrugated fiberboard material;

a container top comprised of a corrugated fiberboard material, said container top including a plurality of apertures therein;

container side wall means for bounding the sides of the container, said side wall means comprised of a corrugated fiberboard material and being structurally coupled to said container top and to said container bottom, said container top, container bottom, and side wall means defining a container interior therebetween; and a lifting sling, said lifting including a sling body and a plurality of strap sections structurally coupled to said sling body, said sling body being located in said container interior, said plurality of strap sections extending from the container interior through said plurality of apertures in said container top to the exterior of the container, wherein said shipping container may be lifted and transported by lifting said plurality of strap sections from the shipping container exterior;

wherein said side wall means includes four side walls defining a rectangular cross-section, said container top including four apertures therein and said lifting sling including four strap sections, each of said strap sections extending from the container interior through a respective aperture.

8. The shipping container of claim 7, wherein said container top is substantially rectangular and has substantially the same dimensions as the cross-section of said container, each of said apertures being located in a respective corner of said container top.

9. The shipping container of claim 8, wherein said lifting sling includes two straps, each strap containing two of said strap sections and having its ends attached to said sling body of said lifting sling.

10. The shipping container of claim 9, wherein said two straps are joined together at their midpoints.

11. The shipping container of claim 10, wherein each strap extends through diagonally opposite corner apertures.

12. The shipping container of claim 9, wherein said two straps are independent of each other.

13. The shipping container of claim 8, wherein said container top includes a load bearing edge adjacent each said corner aperture, wherein said strap portions contact a respective load bearing edge during the lifting of the shipping container.

14. A shipping container comprising:

a container bottom comprised of a corrugated fiberboard material;

a container top comprised of a corrugated fiberboard material, said container top including a plurality of apertures therein;

container side wall means for bounding the sides of the container, said side wall means comprised of a corrugated fiberboard material and being structurally coupled to said container top and to said container bottom, said container top, container bottom, and side wall means defining a container interior therebetween; and a lifting sling, said lifting including a sling body and a plurality of strap sections structurally coupled to said sling body, said sling body being located in said container interior, said plurality of strap sections extending from the container interior through said plurality of apertures in said container top to the exterior of the container, wherein said shipping container may be lifted and transported by lifting said plurality of strap sections from the shipping container exterior;

wherein said container said wall means includes a plurality of side walls, said container bottom includes a bottom closure including a first panel, a second panel, a third panel and a fourth panel, said first panel being foldably joined to one of said side walls, said second panel being foldably joined to another of said side walls, said third and fourth panels each being foldably joined to opposing sides of said second panel, said second panel and one of said third and fourth panels each including an aperture therein, said third and fourth panels being capable of being folded into a position superimposed with respect to said second panel, said apertures of said second and said one of said third and fourth panels at least partially overlapping each other when said third and fourth panels are folded into said superimposed position to create a opening extending through said second and said one of said third and fourth panels permitting access to the container interior through said opening for assembling said bottom closure.

15. A corrugated fiberboard shipping container comprising:

a plurality of side walls forming a polygon-shaped shipping container;

a bottom wall structurally coupled to at least one of said side walls;

a lifting sling having a plurality of strap segments; and a top closure structurally coupled to at least one of said side walls and being polygon-shaped, said top closure having gabled openings therein, said gabled openings located at substantially the comers of said polygon-shaped top closure, said lifting sling being at least partially located within an area defined between said side walls, said bottom wall and said top closure, said strap segments passing through the gabled openings.

16. The shipping container of claim 15, wherein said top closure includes a plurality of panel sections each foldably joined to a respective side wall.

17. The shipping container of claim 15, wherein said top closure includes a top pad detachable from said side walls.

18. The shipping container of claim 17, further including at least two locating slots located in said side walls, said top pad including locating tabs, said locating slots locating and supporting said locating tabs of said top pad.

19. The shipping container of claim 17, wherein said top closure further includes a plurality of panel sections each foldably joined to a respective side wall.

20. The shipping container of claim 19, wherein at least one of said plurality of panel sections including an aperture therein, said top pad including an aperture therein, said apertures being at least partially in a superimposed relationship to permit the discharge of flowable material therethrough.

21. The shipping container of claim 20, wherein said top pad aperture includes a retaining ledge for retaining a fitment of a liner bag.

22. A corrugated fiberboard shipping container comprising a plurality of side walls, a top wall structurally coupled to at least one of said side walls; and a bottom closure, said bottom closure comprising a first panel, a second panel, a third panel and a fourth panel, said first panel being foldably joined to one of said side walls, said second panel being foldably joined to another of said side walls, said third and fourth panels each being foldably joined to only opposing sides of said second panel, said second panel and one of said third and fourth panels each including an aperture therein, said third and fourth panels being capable of being folded into a position superimposed with respect to said second panel, said apertures of said second and said one of said third and fourth panels at least partially overlapping each other when said third and fourth panels are folded into said superimposed position to create a opening extending through said second and said one of said third and fourth panels permitting access to the container interior through said opening for assembling said bottom closure.

23. The shipping container of claim 22, wherein said plurality of side walls include two pairs of opposing side walls, said first and second panels being foldably joined to a pair of opposing side walls.

24. The shipping container of claim 22, wherein the other of said third and fourth panels includes an aperture therein.

25. A corrugated fiberboard shipping container comprising a plurality of side walls, a top wall structurally coupled to at least one of said side walls; and a bottom closure, said bottom closure comprising a first panel, a second panel, a third panel and a fourth panel, said first panel being foldably joined to one of said side walls, said second panel being foldably joined to another of said side walls, said third and fourth panels each being foldably joined to opposing sides of said second panel, said second panel and one of said third and fourth panels each including an aperture therein, said third and fourth panels being capable of being folded into a position superimposed with respect to said second panel, said apertures of said second and said one of said third and fourth panels at least partially overlapping each other when said third and fourth panels are folded into said superimposed position to create a opening extending through said second and said one of said third and fourth panels permitting access to the container interior through said opening for assembling said bottom closure;

wherein said opening is wide enough for the penetration of a user's forearm.

26. A corrugated fiberboard shipping container comprising a plurality of side walls, a top wall structurally coupled to at least one of said side walls; and a bottom closure, said bottom closure comprising a first panel, a second panel, a third panel and a fourth panel, said first panel being foldably joined to one of said side walls, said second panel being foldably joined to another of said side walls, said third and fourth panels each being foldably joined to opposing sides of said second panel, said second panel and one of said third and fourth panels each including an aperture therein, said third and fourth panels being capable of being folded into a position superimposed with respect to said second panel, said apertures of said second and said one of said third and fourth panels at least partially overlapping each other when said third and fourth panels are folded into said superimposed position to create a opening extending through said second and said one of said third and fourth panels permitting access to the container interior through said opening for assembling said bottom closure;

wherein said aperture of said second panel is generally circular and has a diameter of at least 5 inches.

27. A corrugated fiberboard shipping container comprising a plurality of side walls, a top wall structurally coupled to at least one of said side walls; and a bottom closure, said bottom closure comprising a first panel, a second panel, a third panel and a fourth panel, said first panel being foldably joined to one of said side walls, said second panel being foldably joined to another of said side walls, said third and fourth panels each being foldably joined to opposing sides of said second panel, said second panel and one of said third and fourth panels each including an aperture therein, said third and fourth panels being capable of being folded into a position superimposed with respect to said second panel, said apertures of said second and said one of said third and fourth panels at least partially overlapping each other when said third and fourth panels are folded into said superimposed position to create a opening extending through said second and said one of said third and fourth panels permitting access to the container interior through said opening for assembling said bottom closure;

wherein said first panel includes at least one gripping aperture therein to facilitate the gripping of the first panel.

28. A corrugated fiberboard shipping container comprising a plurality of side walls, a top wall structurally coupled to at least one of said side walls; and a bottom closure, said bottom closure comprising a first panel, a second panel, a third panel and a fourth panel, said first panel being foldably joined to one of said side walls, said second panel being foldably joined to another of said side walls, said third and fourth panels each being foldably joined to opposing sides of said second panel, said second panel and one of said third and fourth panels each including an aperture therein, said third and fourth panels being capable of being folded into a position superimposed with respect to said second panel, said apertures of said second and said one of said third and fourth panels at least partially overlapping each other when said third and fourth panels are folded into said superimposed position to create a opening extending through said second and said one of said third and fourth panels permitting access to the container interior through said opening for assembling said bottom closure;

wherein said first and second panel are sized such that their dimensions are substantially equal to the cross-section of the shipping container.

29. The shipping container of claim 28, wherein said third and fourth panels are sized such that their dimensions are substantially equal to the cross-section of the shipping container.

* * * * *